United States Patent [19]

Glorieux et al.

[11] Patent Number: 4,944,176

[45] Date of Patent: Jul. 31, 1990

[54] METAL PLATE BENDING MACHINE

[75] Inventors: Jean-Marie A. Glorieux, Ecole Valentin; Jean-Pierre M. D. Gouget, Besancon, both of France

[73] Assignee: Societe Anonyme DIMECO ALIPRESSE, Miserey Salines, France

[21] Appl. No.: 339,654

[22] Filed: Apr. 18, 1989

[30] Foreign Application Priority Data

Apr. 20, 1988 [FR] France ..... 88 05481

[51] Int. Cl.[5] ..... B21D 5/04

[52] U.S. Cl. ..... 72/319; 72/323

[58] Field of Search ..... 72/323, 319–321, 72/316, 388, 387, 322, 452, 447

[56] References Cited

U.S. PATENT DOCUMENTS

| | | | |
|---|---|---|---|
| 318,088 | 5/1885 | Cooper | 72/447 |
| 826,807 | 7/1906 | Slaysman, Jr. | 72/323 |
| 1,571,558 | 2/1926 | Russell | 72/321 |
| 1,744,391 | 1/1930 | Kuehn | 72/319 |
| 3,786,666 | 1/1974 | York, Jr. | 72/320 |
| 4,043,165 | 8/1977 | Badger et al. | 72/307 |

FOREIGN PATENT DOCUMENTS

| | | | |
|---|---|---|---|
| 0022122 | 1/1981 | European Pat. Off. . | |
| 0023894 | 2/1981 | European Pat. Off. . | |
| 0077314 | 4/1983 | European Pat. Off. . | |
| 288029 | 5/1914 | Fed. Rep. of Germany . | |
| 584362 | 9/1933 | Fed. Rep. of Germany . | |
| 864996 | 5/1941 | France | 72/322 |
| 1525688 | 6/1967 | France . | |
| 2502518 | 3/1981 | France . | |
| 8203340 | 3/1984 | Netherlands | 72/319 |
| 298566 | 7/1954 | Switzerland | 72/320 |

*Primary Examiner*—Daniel C. Crane

*Attorney, Agent, or Firm*—Bacon & Thomas

[57] ABSTRACT

A metal plate bending machine is disclosed having a flap supported by a trolley displaceable in a cradle defining a supporting and guiding track which is in the shape of a concave cylindrical envelope portion, whose concave envelope portion is open in the direction of clamp elements, and with the track supported by a chassis suspended from the frame by a vertical and horizontal position adjustment mechanism. The flap has a radial symmetry with a plane radially passing through the flap and the center of the envelope portion and with the folding head presenting a symmetric profile on either side of the plane.

9 Claims, 6 Drawing Sheets

3
35
36
21
37
38
12
13
10
20
23
f1
11
22
29
24
31
39
14
C
41
50
P
P
4
44
f2
6
28
34
24
27
25
33
32
P'
40
26
5
2
30
1

METAL PLATE BENDING MACHINE

The present invention concerns the technical field of metal plate bending, with the aim to produce articles, products or panels having, at least locally, a succession of folds that can be either positive or negative, depending on the local configuration required, the mechanical resistance obtained and/or subsequently applied treatments.

In the above technical field, a number of solutions have been proposed in the prior art to obtain bends in a metallic plate or sheet.

A first technique involves the use of a blade set into rectilinear, curved or tangential displacement against bending jaws consisting of a bearing bar and a blank tightening clamp blocking the plate to the bent. Such a method is shown in U.S. Pat. No. EP 0 023 894 and U.S. Pat. No. EP 0 077 314.

The folding obtained by a blade displaced tangentially to the bending jaw of the bearing bar and blank tightening clamp is characterized by a sliding of the blade which causes markings on the plate. Such a process cannot be considered when dealing with plates having an initial surface state resulting from, eg. a surface polish, laquering or any other surface application or treatment and whIch needs to be protected.

Apart from these drawbacks, it should be noted that blade type machines generally only have one working direction so that the blank or plate to be bent needs to be turned over every time an inversion in the folding direction is required.

In an attempt at reducing this drawback, it has been proposed, notably in U.S. Pat. No. EP 0 022 122, to provide a bending machine with two superimposed blades, located on other side of the blocking and tightening plane of the blank or plate, between the bearing bar and the blank tightening clamp. This concept undoubtedly enables to overcome the drawback of having to turn over the blank or plate. However, the operating principle of such a machine still requires the relative displacement of one or the other of the blades, so that the bent plate is subject to the same surface attacks, responsible for markings corresponding to the relative sliding with respect to the folding radius.

Manufacturing techniques for articles, products or objects made from folded plate having a prior surface treatment by any suitable operation do not allow the use of such machines or processes which prevent obtaining finished products having an irreproachable finish.

Prior art also proposes another family of plate bending machines in which the element causing the bend in the blank is formed by a flap susceptible of rotational displacement along an axis that is parallel to that of the bending jaws.

An example of this method is illustrated in U.S. Pat. No. FR 2 236 992 (75-40 066) in which it apparently seems that the discussed construction implies that the blank or plate must always be turned over when carrying out successive folds in different orientations, eg. positive and negative.

With this send type of machine, it is also proposed in prior art a machine of the type illustrated by U.S. Pat. No. FR 2 502 518 (81-06 573).

According to the succeeding and incomplete teaching of this patent, it would appear that the bending of a blank is driven by means of a pivoting flap, susceptible of displacement by rotation around an axis parallel to the tightening plane, from a horizontal position towards the bottom for carrying out a negative bend, and from a vertical position up to a horizontal position, for carrying out a positive bend.

Although this proposal can appear as an improvement in the previous method, owing to the possibility of successively carrying out folds having different orientations, it should be noted however that the implemented system does not prevent the marking of the plate or blank resulting from the action of the flap which a]ways causes serrations or scratches that are damaging to this surface treatment previously applied to the blank on plate.

Besides, the disclosed teaching gives no detail as to the means provided to bypass the folds produced by the movable flap when carrying out a succession of inverted folds for which it is required to place the movable flap on either side of the tightening and locking surface of the blank or plate.

Moreover, it should be noted that the technical arrangements illustrated do not appear to allow bends to be formed at an angle greater than 90°, a need that is clearly apparent with present manufacturing methods based on folding elements forming more-or-less complex metallic structures using the blanks or metal plates which need to be rigidified and strengthened by folds.

The aim of the present invention is to provide a solution to the above-cited problems which have not been solved by known techniques. The object of the present invention is to provide a structure for a flap type metal plate bending machine enabling to produce in an arbitrary way, without turning over the blank or plate, successive positive and/or negative folds, in which the folding angles can be less than, equal to or greater than 90°.

Another object of the invention is to provide a structure for a plate bending machine allowing by simple transfer or translation of the blank or workpiece, the production of a series of complex and combined folds, that can be easily bypassed in their occupied space by the machine's active tools which are capable of being brought to the position required to carry out a fold following those already carried out.

Another aim of the present invention is to provide means for carrying out successive folds in any order and in any direction without giving rise to markings, scratches or any other deterioration of either of the faces of the blank or plate to be folded, through the use of a rotating flap.

Another aim of the invention is to provide a novel machine, capable of carrying out folds that can be either positive or negative without tuning over the blank or plate, capable of being implemented in an automated production line and potentially able to receive quickly and simply modified work parameters to provide it with substantial flexibility.

To achieve these above aims, the bending machine according to the invention is characterized in that :

a trolley is displaceable in a cradle defining a supporting and guiding track, in the shape of a concave cylindrical envelope portion, open in the direction of clamps, and whose symmetrical centre is located in proximity to a set, the track is supported by a chassis suspended from the frame by vertical and horizontal position adjustment means, and in that the flap has a radial symmetry plane passing through the centre of the envelope portion and has a folding head presenting a symmetric profile on either side of said plane.

Various other characteristics will become evident from the description given below with reference to the appended drawings which show, as non-restricting examples embodiments of the present invention.

FIGS. 7 and 8 are schematic front cross-sectional views illustrating two other characteristic operating positions, in relation with the sequences according to FIGS. 3 and 5.

Figure 1:
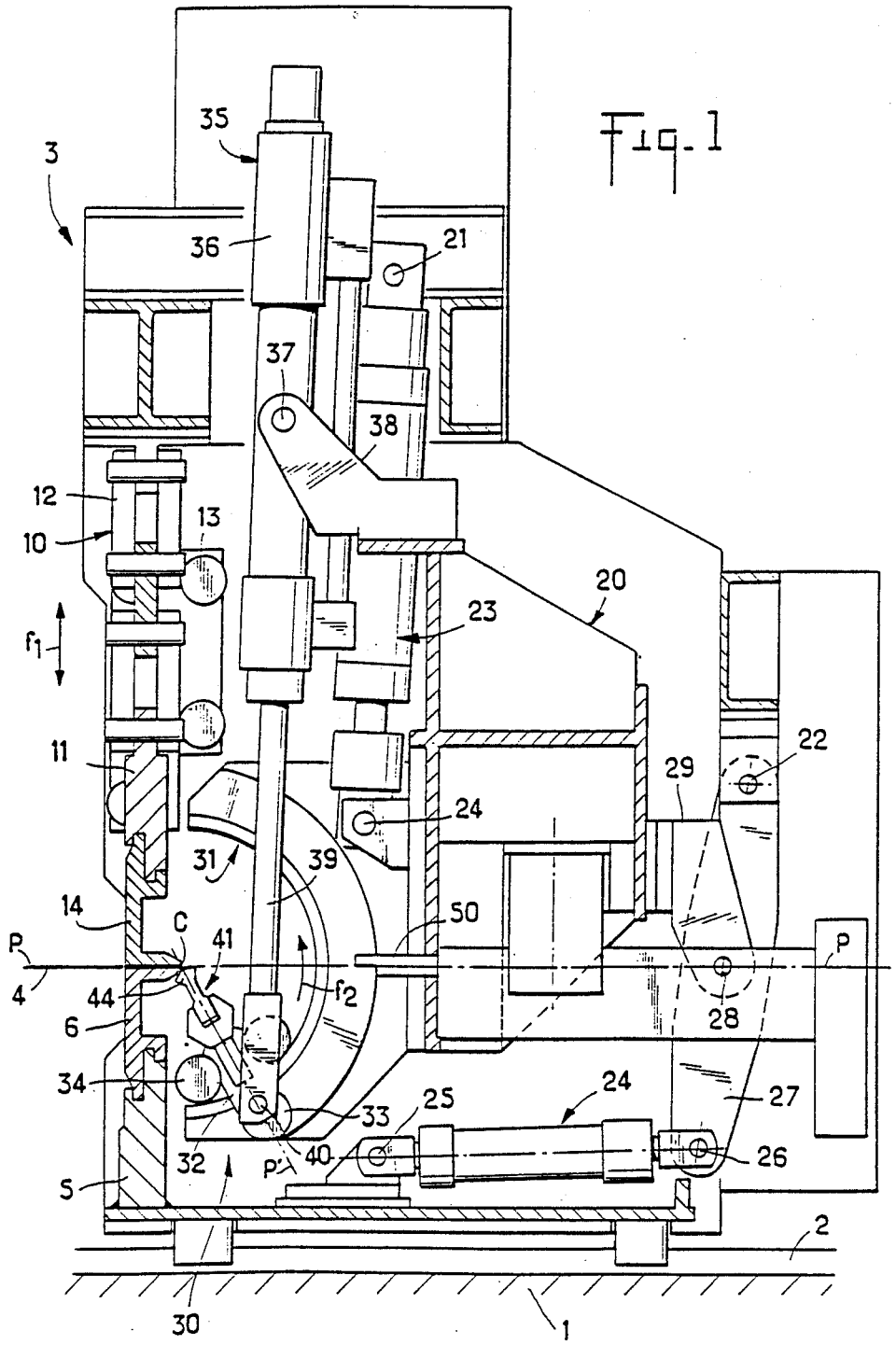
FIG. 1 is a schematic front cross-sectional view of a bending machine according to the invention.

The folding machine according to the invention comprises, as can be seen from FIG. 1, a bed defining a rectilinear displacement guide track 2 for a mobile frame 3 supporting the main handling and bending devices acting on a plate or blank 4 placed flat along a horizontal feeding and transfer plane P.

The front part of the mobile frame 3 comprises a bearing bar 5 extending vertically from the base and bearing a fixed lower clamp 8. As can be seen from FIG. 2 the clamp 6 forms a bending jaw 7 extending inside the machine. The jaw 7 has a bending edge 8 defined by a shoulder or rounded edge centred on a bending and winding axis 9 parallel to plane P.

The frame 3 supports, by its superstructure and in a vertical plane superimposed on the bearing bar 5, a knee piece 10 of the opening and closing type. The knee piece 10 is formed, in a known manner, by a movable plate il suspended from the superstructure of the frame 3 by a plurality of articulated parallelograms 12 associated to one or several actuating jacks 13. The knee piece l2 is formed so that the plate II can be displaced vertically along either direction of arrow $f_1$, with respect to the bearing bar 5. At the base of the plate 11 is located a blank tightening clamp 14 aligned with clamp 8 and forming a bending jaw 15 extending parallel to, and in the same direction as jaw 7. The bending saw 15 has s bending edge 1B formed by a rounded edge or shoulder centred on a winding axis 17 parallel to plane P.

Figure 3:
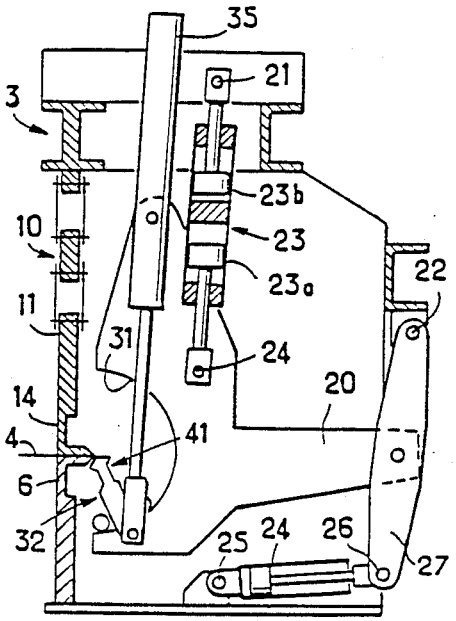
FIG. 3 is schematic view showing a characteristic operating position of the elements constituting the machine.

The frame 3 supports, behind its front face and in tho direction of the jaws 7 and 15, a mobile chassis which is suspended via two articulation axes 21 and 22 respectively. Articulation axis 21 extends horizontally, parallel to the jaws 7 and 15, and is set in the upper portion of the mobile frame 3 and to the rear of the plane containing the bearing bar 5 and the plate ii. The chassis 20 is suspended on axis 21 via a motor element 23 having a rectilinear stroke, intended to allow adjustment of the horizontal portion of chassis 20. Preferably, as shown in FIG. 3, the motor element is formed of two double-acting hydraulic jacks 23*a* and 23*b* which can be selectively activated for each cf the variable volume chambers they define The double jack 23 is connected articulated, by one of its piston rods, to axis 21 and, by the other, to a pivot or axis 24 borne by the chassis 20.

Suspension of the chassis 20 by the axis 22 is ensured such that the latter is set parallel to axis 21 by being located at a lower level than the latter and by occupying a position more shifted towards the rear with respect to the common plane of the bearing bar and plate 11. The chassis 20 is suspended from axis 22 via an interposed motor element 24 serving to control the displacement or adjustment of chassis 20 in a horizontal position.

Preferably, the motor element 24 is of the rectilinear stroke type, such as a hydraulic or pneumatic jack. FIG. 1 shows an example of a structure in which the jack 24 is articulated by an axis 25 on the mobile frame 8 and by an axis 26 on one of the branches of a crossbar or lever 27 articulated by its other branch on axis 22. The crossbar or lever 27 is joined at its central portion by an articulation axis 28 at a rear extension 29 of the chassis 20.

At its portion opposite the extension 29 and facing the bending jaws 7 sandle, the chassis forms a cradle 30 defining a guiding and rolling track 31. The track 31 has the form of a concave cylindrical envelope portion open towards the bending jaws 7 and 15, whose geometrical centre c is located in proximity to axes 9 and 17 The track 31 serves as support for a trolley 32 set on the track 31 with rolling capability by means of rollers 33 and counter-rollers 34. The trolley 32 has a symmetry plane P' occupying a radial direction centred on the centre c of the track 31. The trolley 32 is coupled to a motor element 35 supported by the chassis 20 In one embodiment, the motor element 35 is of the linear type, such as a double-acting hydraulic jack whose body is joined to a crown 38 on the chassis 20 by grudgeons 37. The piston rod 39 of jack 35 is directly articulated by an axis 40 on the trolley 32. Activation of the jack 35 consequently enables, by an extension or retraction of the piston rod 39, to displace the trolley along the track 81 eg. along the direction of the arrow $f_2$ from the positiOn shoWn in FIG. 1 and vice versa.

The trolley 32 carries on plane P' a flap 41 that can take an adjustabIe position, via adjustment elements such as screws 42 and one or several spacer blocks 43. These adjustment elements enable the position of the flap 41 to be adapted to the thickness of the plate or blank to be bent. Tho flap 41 forms a head 44 extending parallel to plane P and presenting, in a transversal cross-section, a symmetrical profile on either side of symmetry plane P'. In a preferred embodiment, the profile 45 is defined by two inclined planes 46*b* and 46*b* converging towards a flat 47 extending perpendicular to symmetry plane P'. Preferably, the inclined planes respectively subtend an angle $\alpha$ equal to 60° with respect to symmetry plane P'.

Figure 2:
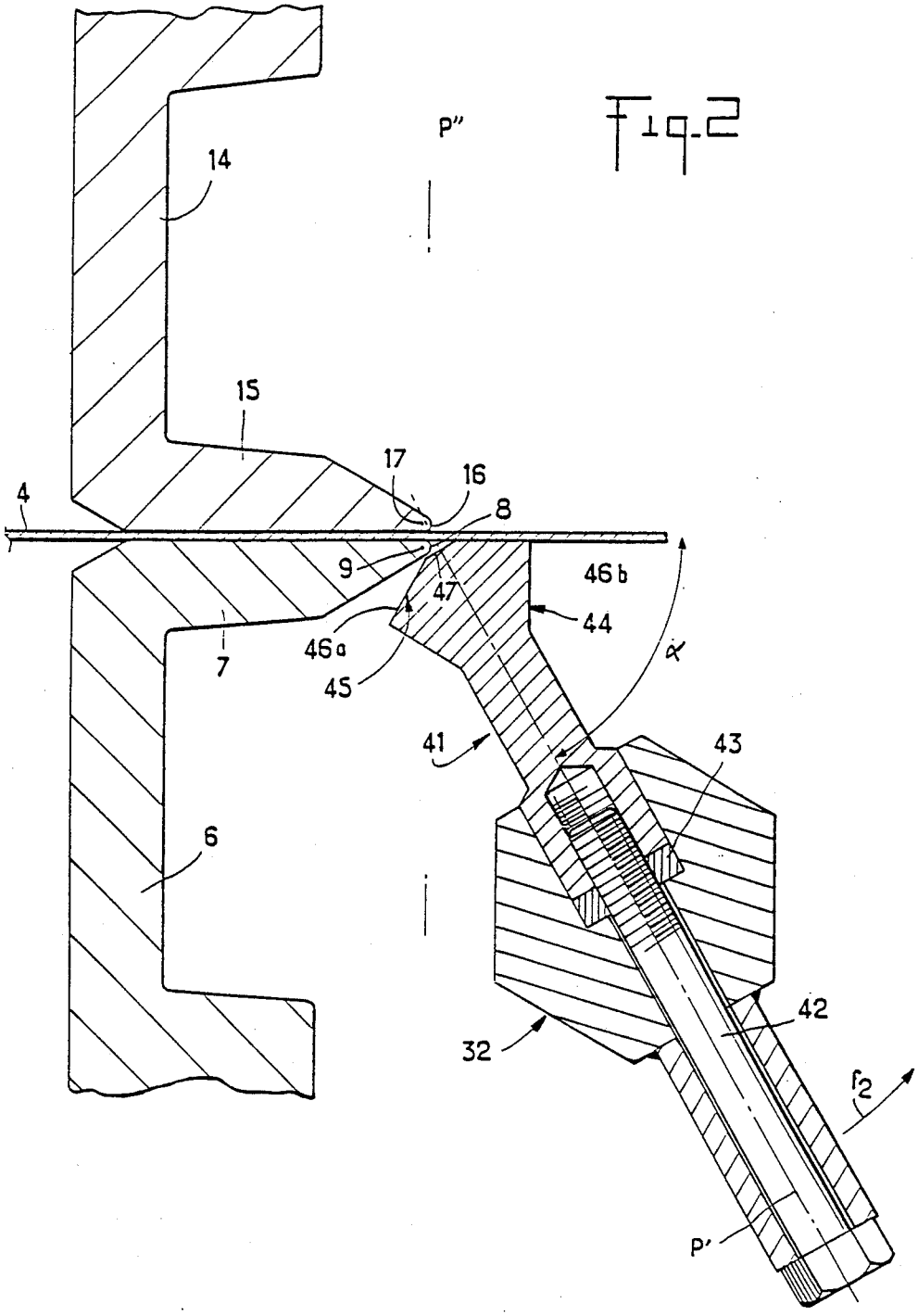
FIG. 2 is a partial front cross-sectional view showing a detail on the embodiment on a larger scale.
Figure 2A:
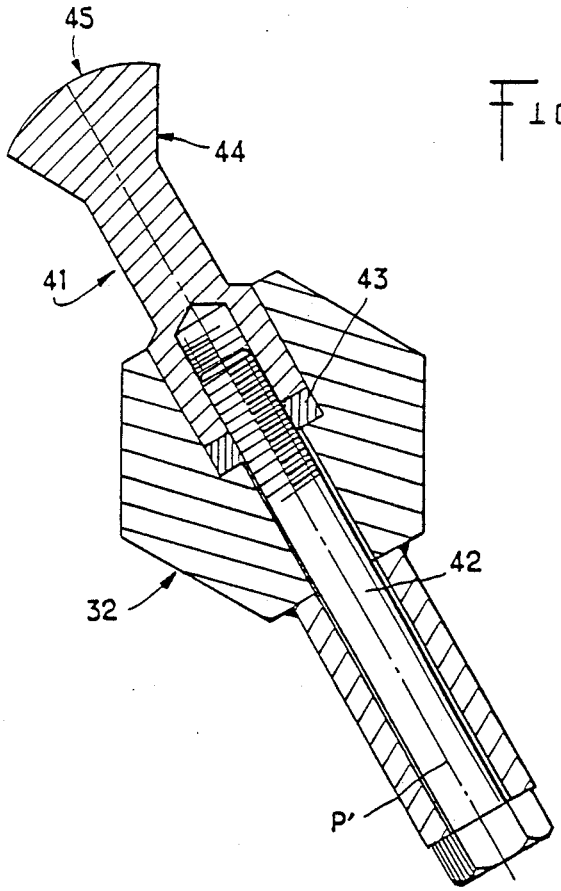
FIG. 2A is a front cross-sectional view of an alternative embodiment of the element shown in FIG. 2.

FIG. 2*a* shows that the profile 45 can also be formed by one or several radii of curvature disposed symmetrically on either side of plane P'.

In all embodiments the flap 41 has a head 44 whose length is in the region of, or preferably equal to, that of the bending jaws 7 and 15.

The above described bending mohican operates in the following manner.

It will be supposed that a positive fold, i.e. a fold towards the top from the feeding plane P, is to be carried out on a plate or blank 4 . The flap 41 is placed in the position shown by FIGS. 1, 2 and 4. The plate or blank 4 is then placed on jaw 7, after opening of the tightening clamp 14 via plate 10. The plate or blank is inserted until it comes against adjustable and retractable thrust-blocks 50 for depth adjustment controlled eg. by jacks. When the required position is reached, the plate 10 is set along a closing path so as to bring down the blank tightening clamp 14 to pinch the blank or plate 4 between the jaws 15 and 7. In such a position, shown in FIGS. 2 to 4, the blank or plate 4 extends, in a desired manner beyond an imaginary plane P″ passing by the bending edges or shoulders 8 and 18 of the jaws 7 and 15.

Figure 4:
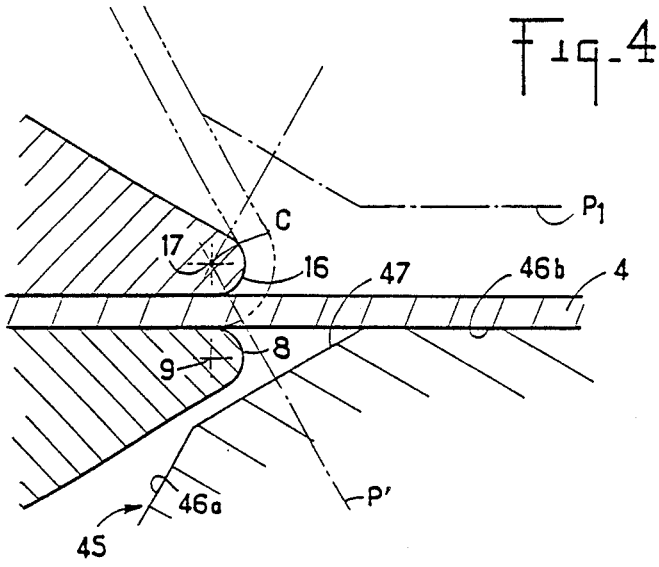
FIG. 4 is a partial front cross-sectional view showing, on a larger scale, an operating detail of the machine according to the sequence of FIG. 3.
Figure 5:
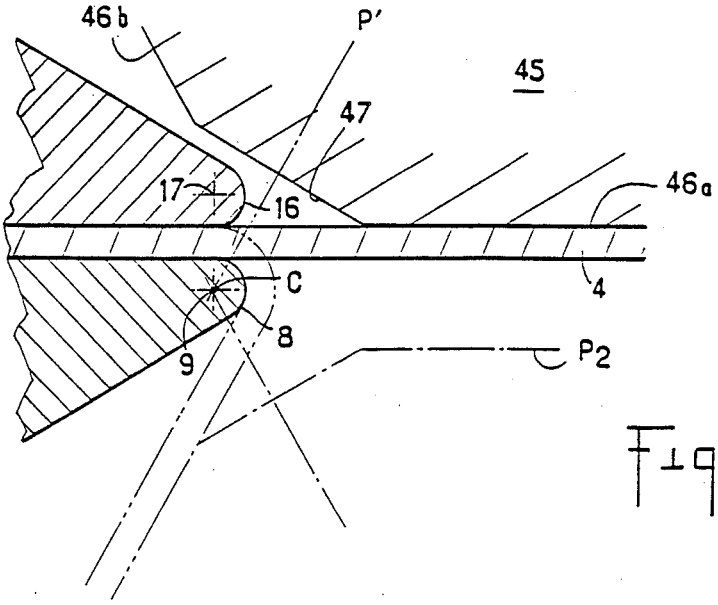
Figure 9:
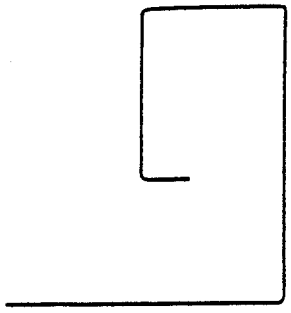
FIGS. 9 to 14 are schematic views illustrating some of the results obtainable with a machine according to the invention.
Figure 10:
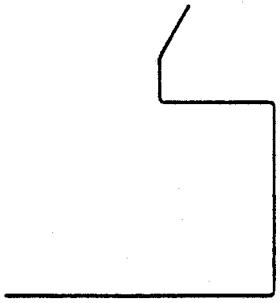
Figure 11:
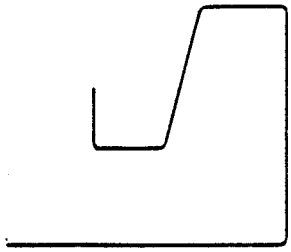
Figure 12:
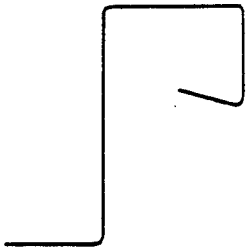
Figure 13:
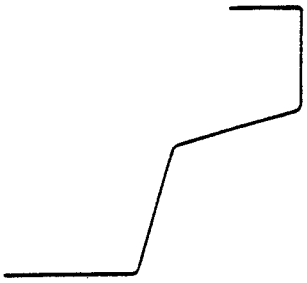
Figure 14:
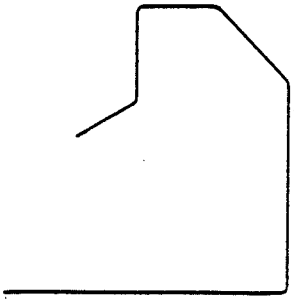

The motor elements 23 and 24 are then activated, so as to make the centre c coincide with the folding axis 17 such that symmetry plane P′ passes through that axis as can ba seen in FIGS. 2 and 4.

The motor element 35 is then activated to cause the cylinder rod 39 to retract so as to solicit the displacement of the trolley 32 along the direction of the arrow $f_2$ on the track 31. The head 44 of the flap 41 thus comes to bear on the lower face of the plate or blank 4 and, by its inclined plane **46*b*, causes the folding of the latter by forcing it to roll round the edge 8. The motor element 35 is driven so as to impart an angular displacement range on the flap 41**, corresponding to the folding angle to be observed.

It will be noted that the presence of the bending jaw 7 and the specific shape of the head 44 enable a positive bend to be produced on an annular amplitude greater than 90°. Depending on the shape of the work-face given to sides **46*a* and 48*b***, a fold can be achieved over an angular range of values between 0° and 120°.

Figure 5:
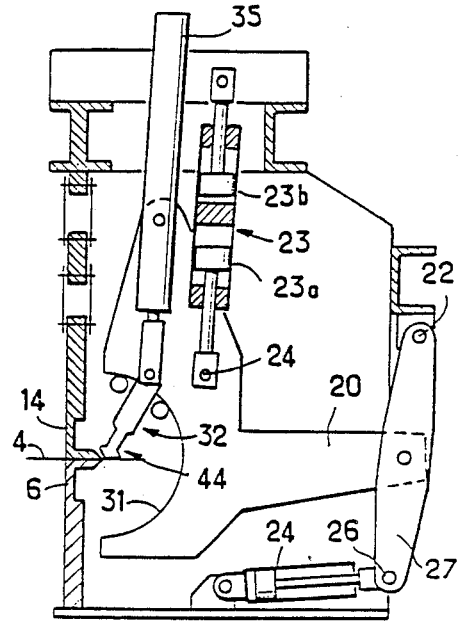
FIG. 5 is a schematic front cross-sectional view, analogous to FIG. 4, illustrating another operating sequence.
Figure 6:
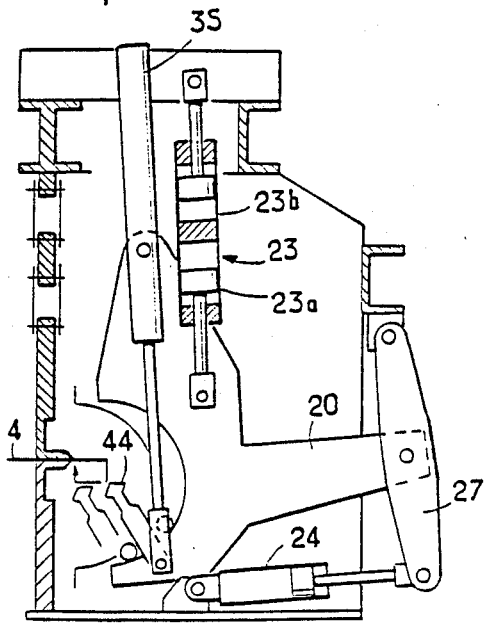
FIG. 6 is a front cross-sectional view on a larger scale, analogous to FIG. 4, highlighting the same operating principle in relation to FIG. 5.

FIGS. 5 and 6 show that it is equally possible to carry out, in a similar manner, is negative fold i.e. orientated towards the bottom, by initially setting the trolley so that it has a high starting position, so that the symmetry plane P′ passes along axis 9 on which is equally centred the centre c Of the track 31. In this case, the motor element 35 is then activated for an extension stroke so as to displace the trolley 2 in the opposite direction to the arrow $f_2$, causing the blank to wind on the edge 8 over a range of angles which can also cover 0° to 120°.

After carrying out a positive fold, such as shown in FIG. 4, or a negative fold, such as shown in FIG. 6, the head 44 takes either position $p_1$ or position $p_2$.

Figure 7:
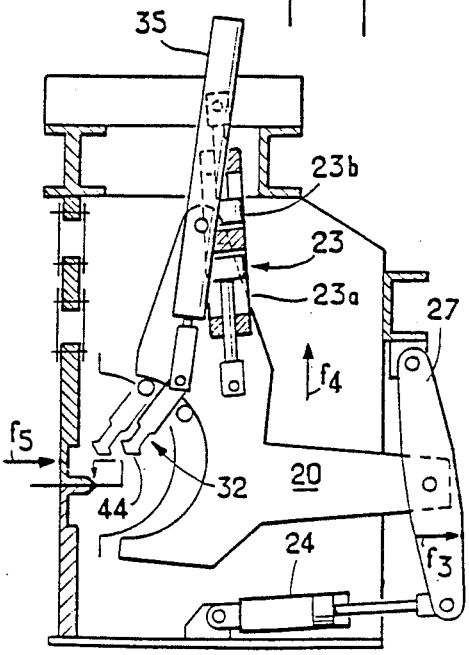

When a second fold needs to be carried out it will be appreciated that from the positions shown in FIGS. 4 and 6, the head 44 will have to be cleared before feeding the plate or blank 4 after opening the blank tightening clamp 14. This clearing operation is also necessary to withdraw the head 44 sufficiently to allow free passage of the obtained fold. The clearing of the head 44, after carrying out a positive fold and assuming that a negative fold then needs to be carried out, is illustrated in FIG. 7. This clearing is achieved first of all by activating the motor element 24 serving to backtrack the chassis 20 , and consequently the head 44, along the direction of the arrow $f_3$ by an amount corresponding to the subsequent advance to be imparted to the blank 4.

Next, or simultaneously, the motor element 23 is activated to cause the disengagement or vertical displacement of the chassis 20 along the direction of the arrow f over a height corresponding, by an excessive amount to that of the fold just carried out.

The blank tightening clamp 14 can then be set open to allow the transfer or transition of the plate 4 along the direction of the arrow $f_5$. over a distance corresponding to the spacing to be maintained between the first fold carried out and the second fold to be performed.

In this position the motor element 24 is then activated in the reverse direction so as to advance the chassis 20 in the opposite direction to the arrow $f_3$. The motor element 23 is then activated to lower the chassis 20 in the direction opposite to arrow $f_4$, in order to make the plane P′ pass by the winding axis 9, assuming that a negative fold is being carried out for the second fold.

When the centre c coincides with the axis 9, this second fold is performed solely by activating the motor element 35, causing the displacement of the trolley 32 in a direction opposite to that of the arrow $f_2$ over an angle corresponding to the folding amplitude required.

FIG. 8 shows an intermediate phase in the bed 1, occurring after carrying out a negative fold and when a positive fold is next required on tho same blank or plate 4.

As is brought out in the above the machine's structure, involving a chassis suspended on two parallel articulating axes, associated to individual motor elements and a guide track having the form of a concave cylindrical envelope portion hearing a pivoting trolley supporting a rotatable flap, enables the production of any succession of positive and negative folds, without turning over, automatically or not, simply by controlling the sequential phases for activating the motor elements 23, 24 and 35. Many possible different arrangements can thus he implemented, either by manual control or by programmed automatic control.

Fast, complex volume production sequences can thus take place without requiring skilled operating and handling staff as is required with existing machines Moreover, the only monitoring required being that for activating the jacks 23, 24 and 35 and for the feedthrough rate of the blank or plate, it then becomes possible to operate such a machine with a high degree of flexibility, which is of great advantage in industry for pivoting production lines.

Given the possibility of making the centre c of the track 31 coincide with the centre or axis of the shoulder or bending edge as a function of the fold to be performed, it then becomes possible to fold without risk of marking the external surface, any type of plate, including those having an initial surface treatment by means of the flap 41 submitted only to a rotational displacement causing the winding of the part of the plate or blank to be folded directly un the bending edge. Successive folds or complex folding zones, even those that are relatively complex, can thus be performed on blanks or plates having received a final surface treatment such as polishing, laquering, anodisation, etc.

FIGS. 9 to 14 show, by way of example, the possibilities of successive folds that can be programmed with a machine according to the invention, without calling on operating staff. These different production examples show that it is possible to conduct successively and in an arbitrary order, positive and negative folds, over variable angles less than, equal to, or greater than 90°.

The invention is not limited to the examples described and shown since various modifications can be brought to them without departing from its scope.

We claim:

1. A metal plate bending machine comprising:

(a) a machine frame;

(b) clamping means to clamp a metal plate such that it extends in a feeding and transfer plane P;

(c) a pair of bending jaws located on either side of plane P, each bending jaws having a bending edge extending substantially parallel to plane P;

(d) a guiding and rolling track having a partial cylindrical configuration about a central axis C extending substantially parallel to plane P;

(e) a bending flap having a plane of symmetry P' and a bending surface for bending said metal plate extending substantially parallel to plane P;

(f) means movably attaching the bending flap to the guiding and rolling track so that the bending flap rides in said track such that the plane of symmetry p' extends generally radially from the central axis C and the angle between the plane of symmetry P' and plane P can be varied to bend said metal plate;

(g) a sub-frame chassis movably suspended from the frame and having the guiding and rolling track mounted thereon; and (h) actuating means operatively interposed between the frame and the suspended sub-frame chassis to move the sub-frame chassis with respect to the frame so as to move the guiding and rolling track and, consequently the bending flap, with respect to the bending jaws.

2. The metal plate bending machine according to claim 1 further comprising adjusting means operatively associated with the bending flap so as to adjust the position of the bending flap in a direction substantially parallel to the plane of symmetry P'.

3. The metal plate bending machine according to claim 1 wherein the bending surface is symmetrical on either side of plane P'.

4. The metal plate bending machine according to claim 3 wherein the bending surface comprises a generally flat central portion extending generally perpendicular to plane P' and generally flat lateral portions extending from the central portion at an angle to the plane P'.

5. The metal plate bending machine according to claims 3 wherein the bending surface is curved.

6. The metal plate bending machine according to claim 1 wherein the actuating means comprises:

(a) a first actuator;

(b) first attaching means attaching to first actuator to the frame so as to pivot about a first pivot axis extending generally parallel to the plane P and to the sub-frame chassis;

(c) a second actuator; and, (d) second attaching means attaching the second actuator between the frame and the sub-frame chassis such that the chassis moves about a second pivot axis extending generally parallel to the plane P.

7. The metal plate bending machine according to claim 6 wherein the first actuator comprises two double acting jack linear motors placed in opposition.

8. The metal plate bending machine according to claim 7 wherein the second actuator comprises a double acting linear motor.

9. The metal plate bending machine according to claim 8 further comprising at least one lever having a first end pivotally attached to the frame so as to the pivot about the second pivot axis, a second end attached to the second actuator and a portion attached to sub-frame chassis.

* * * * *